US009804559B2

(12) United States Patent
Kamizato et al.

(10) Patent No.: US 9,804,559 B2
(45) Date of Patent: Oct. 31, 2017

(54) IMAGE FORMING APPARATUS INCLUDING A MOVING MEMBER CONFIGURED TO MOVE A CARTRIDGE

(71) Applicant: CANON KABUSHIKI KAISHA, Tokyo (JP)

(72) Inventors: Shoji Kamizato, Susono (JP); Takayuki Yada, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/948,759

(22) Filed: Nov. 23, 2015

(65) Prior Publication Data

US 2016/0154375 A1 Jun. 2, 2016

(30) Foreign Application Priority Data

Nov. 28, 2014 (JP) ..... 2014-242594

(51) Int. Cl.
*G03G 21/00* (2006.01)
*G03G 21/18* (2006.01)
*G03G 21/16* (2006.01)

(52) U.S. Cl.
CPC ..... *G03G 21/1842* (2013.01); *G03G 21/1623* (2013.01); *G03G 21/1853* (2013.01);
(Continued)

(58) Field of Classification Search
CPC ..... G03G 21/1842; G03G 21/1623; G03G 21/1853; G03G 2221/1684; G03G 2221/1869
(Continued)

(56) References Cited

U.S. PATENT DOCUMENTS 7,899,364 B2 * 3/2011 Chadani ..... G03G 21/186 399/111
8,744,311 B2 * 6/2014 Sato ..... G03G 15/0189 399/110
(Continued)

FOREIGN PATENT DOCUMENTS

JP H06-316347 A 11/1994
JP 2007-213018 A 8/2007
(Continued)

*Primary Examiner* — Robert Beatty
(74) *Attorney, Agent, or Firm* — Canon U.S.A. Inc., IP Division

(57) ABSTRACT

An image forming apparatus includes an apparatus main body, a cartridge including a supported portion, a moving member configured to move to the apparatus main body and thereby move the cartridge, the moving member moving to the apparatus main body so as to be in an external position and an internal position, a main body side positioning portion provided on the apparatus main body and configured to, when the moving member is in the internal position, support the supported portion, and an upward inclination portion provided on the apparatus main body and inclined upwardly from a movement direction in which the moving member moves from the external position to the internal position. The upward inclination portion causes the cartridge to move upward with respect to the moving member in a process in which the moving member moves from the external position to the internal position.

11 Claims, 9 Drawing Sheets

(52) U.S. Cl.
CPC ..... *G03G 2221/1684* (2013.01); *G03G 2221/1869* (2013.01)

(58) Field of Classification Search
USPC ..... 399/111, 112
See application file for complete search history.

(56) References Cited

U.S. PATENT DOCUMENTS

| | | | | |
|---|---|---|---|---|
| 2009/0142092 | A1* | 6/2009 | Sato | G03G 21/1846 399/111 |
| 2009/0324283 | A1* | 12/2009 | Mushika | G03G 21/1619 399/119 |
| 2011/0299882 | A1 | 12/2011 | Tanaami | |
| 2015/0139689 | A1* | 5/2015 | Suzuki | G03G 21/1623 399/110 |

FOREIGN PATENT DOCUMENTS

| | | | |
|---|---|---|---|
| JP | 2009-57157 | A | 3/2009 |
| JP | 4241819 | B2 | 3/2009 |

* cited by examiner

IMAGE FORMING APPARATUS INCLUDING A MOVING MEMBER CONFIGURED TO MOVE A CARTRIDGE

BACKGROUND OF THE INVENTION

Field of the Invention

The present invention relates to an image forming apparatus for forming an image on a recording medium.

Description of the Related Art

Image forming apparatuses in which a cartridge including a photosensitive drum and a process unit for acting on the photosensitive drum is detachably attachable to an apparatus main body have been known.

Among such image forming apparatuses, some include, for example, a tray provided to be movable with respect to the apparatus main body to facilitate insertion of the cartridge into the apparatus main body. In Japanese Patent Application Laid-Open No. 2007-213018, a tray with a cartridge supported thereon is inserted into and drawn out of an apparatus main body to implement attachment and detachment of the cartridge to/from the apparatus main body.

The cartridge attached to the apparatus main body needs high positional accuracy for improved image quality. According to the foregoing conventional technique, to improve the positional accuracy of the cartridge, the tray inserted into the apparatus main body is separated from the cartridge, and the cartridge is supported by a supporting portion provided on the apparatus main body. To separate the tray from the cartridge, a conventional configuration may include a link mechanism interlocked with opening and closing of a door to retract the tray vertically downward.

According to such a conventional technique, to make the supporting portion of the apparatus main body support the cartridge, the link mechanism for retracting the tray in an interlocking manner with a closing operation of the door needs to be arranged inside the image forming apparatus. This can complicate the configuration of the image forming apparatus and incur additional cost or cause an increase in the size of the image forming apparatus.

SUMMARY OF THE INVENTION

The present invention is directed to simplification of an image forming apparatus. More specifically, the present invention is directed to making an apparatus main body support a cartridge according to an operation for moving a moving member to which the cartridge is attached into the apparatus main body.

According to an aspect of the present invention, an image forming apparatus for forming an image on a recording medium includes an apparatus main body, a cartridge including a supported portion, a main body side positioning portion provided on the apparatus main body and configured to position the cartridge in a position capable of image formation by supporting the supported portion, a moving member configured to move with respect to the apparatus main body and thereby move the cartridge, the moving member being moveable between an external position, in which the moving member is positioned at least partially outside the apparatus main body and wherein the cartridge is attachable and attachable from the image forming apparatus when the moving member is in the external position, and an internal position in which the moving member is positioned at least substantially inside the apparatus main body and wherein the cartridge is positioned by the main body side positioning portion when the moving member is in the internal position, and an upward inclination portion provided on the apparatus main body and inclined upwardly from a movement direction in which the moving member moves from the external position to the internal position, wherein the upward inclination portion is configured to come into contact with the cartridge and to move the cartridge upward with respect to the moving member in a process in which the moving member moves from the external position to the internal position.

Further features of the present invention will become apparent from the following description of exemplary embodiments with reference to the attached drawings.

DESCRIPTION OF THE EMBODIMENTS

An image forming apparatus in which a process cartridge is detachably attached to an apparatus main body and which forms an image on a recording medium according to an exemplary embodiment of the present invention will be described with reference to the drawings.

An image forming apparatus as employed herein refers to one that uses an electrophotographic forming process to form an image on a recording medium. Examples of the image forming apparatus include an electrophotographic copying machine, an electrophotographic printer, a facsimile apparatus, and a word processor. A recording medium refers to one on which the image forming apparatus forms an image. Examples include paper and an overhead transparency (OHT) sheet.

<Overall Configuration of Apparatus>

Figure 1:
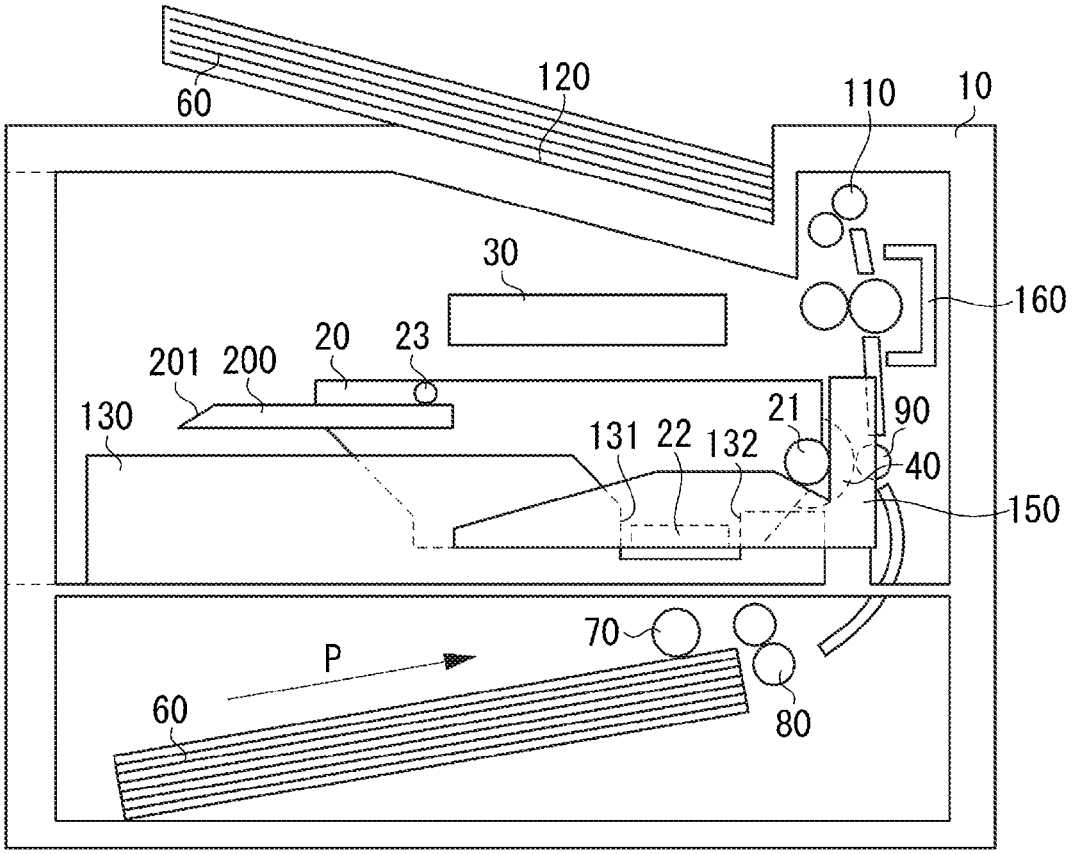
FIG. 1 is a sectional view illustrating an image forming apparatus according to a first exemplary embodiment.
Figure 2:
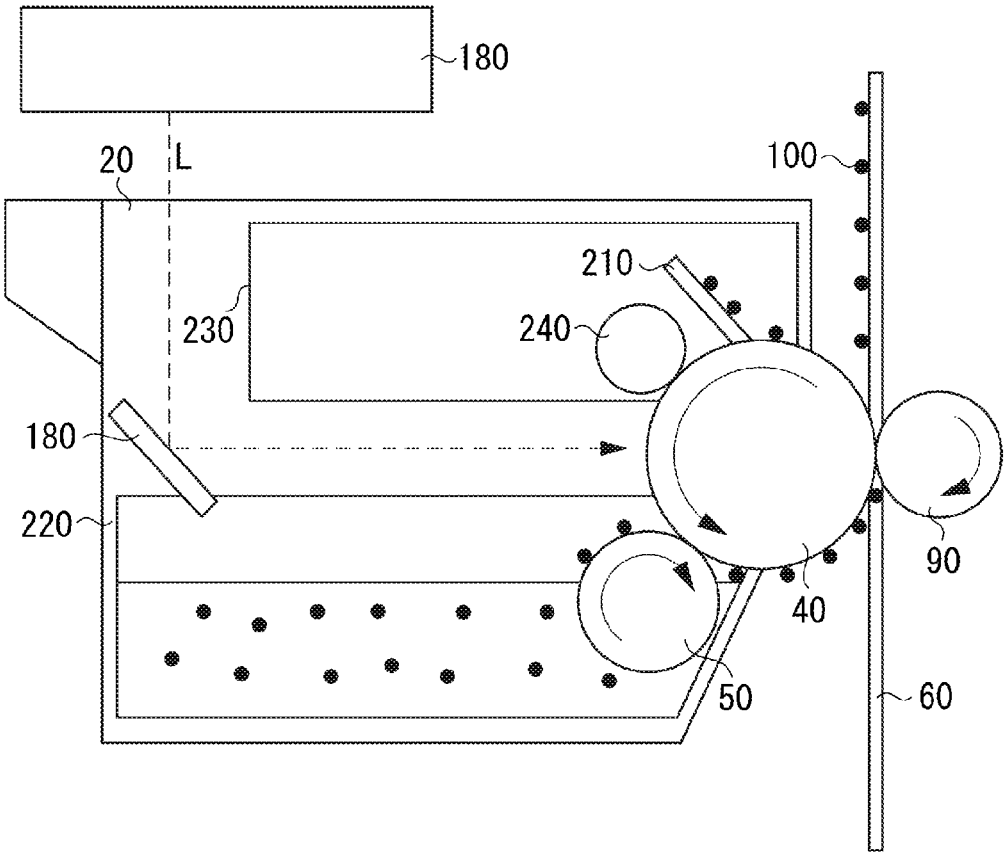
FIG. 2 is a sectional view illustrating a process cartridge applicable to the image forming apparatus.

An overview of the image forming apparatus will be described. An overall configuration of an image forming apparatus main body will be described with reference to FIG. 1. An overview of the process cartridge will be described with reference to FIG. 2. FIG. 1 is a sectional view illustrating an image forming apparatus according to a first exemplary embodiment. FIG. 2 is a sectional view illustrating the process cartridge during image formation.

An overview of the image forming apparatus according to the first exemplary embodiment will be described. As illustrated in FIG. 1, an image forming apparatus main body (hereinafter, referred to as an apparatus main body) 10 includes a process cartridge 20. A scanner unit 30 is arranged above the process cartridge 20 attached to the apparatus main body 10.

A recording medium 60 stored in a feeding unit is fed in a feeding direction P by a feed roller 70 which rotates counterclockwise. The recording medium 60 is then conveyed from a conveyance roller 80 to a photosensitive drum 40 and a transfer roller 90. A bias is applied to the transfer roller 90 so that a developer image formed on a surface of the photosensitive drum 40 is transferred to the recording medium 60. The recording medium 60 to which the developer image is transferred is then conveyed to a fixing unit 160 for heating and pressurization. As a result, the developer image is fixed to the recording medium 60. The recording medium 60 to which the developer image is fixed is discharged onto a discharge tray 120 by a discharge roller 110.

Next, an overview of an operation inside the process cartridge 20 will be described with reference to FIG. 2. In the process cartridge 20, when image forming is performed, the surface of the photosensitive drum 40 is electrically charged by a charging roller 240. Laser light L of the scanner unit 30 is reflected by a mirror 180 to scan and expose the surface of the photosensitive drum 40 according to image information. With the above process, an electrostatic latent image is sequentially formed on the surface of the photosensitive drum 40. Then, the electrostatic latent image is developed by a developing roller 50 in a developing unit 220, whereby a visible image (developer image) of a developer 100 is formed on the surface of the photosensitive drum 40. The photosensitive drum 40 is an image bearing member which bears a developer image. The developing roller 50 is a developer bearing member which bears the developer 100 and develops a latent image (electrostatic latent image) formed on the photosensitive drum 40 to form a developer image.

The visible image of the developer 100 formed on the photosensitive drum 40 is transferred to the recording medium 60. The developer 100 that is not transferred in the transfer position and left on the surface of the photosensitive drum 40 is scraped off by a cleaning blade 210 and stored in a cleaning unit 230.

FIGS. 3A to 3D are perspective views each illustrating the apparatus main body 10. An overview of an operation for attaching the process cartridge 20 will be described with reference to FIGS. 3A to 3D. To improve the user's operability when replacing the process cartridge 20, the process cartridge 20 is configured to be supported by a tray 130 slidable with respect to the apparatus main body when the process cartridge 20 is drawn out of the apparatus main body 10. As image formation proceeds, the developer 100 stored in the developing unit 220 in the process cartridge 20 is consumed. When the developer 100 is consumed, the process cartridge 20 needs to be replaced. To replace the process cartridge 20 in the image forming apparatus according to the present exemplary embodiment, the process cartridge 20 is attached to and detached from the tray 130 in the direction of the arrow F. The tray 130 is a moving member (cartridge support member or moveable member) which moves with respect to the apparatus main body 10 with the process cartridge 20 attached thereto.

Figure 3A:
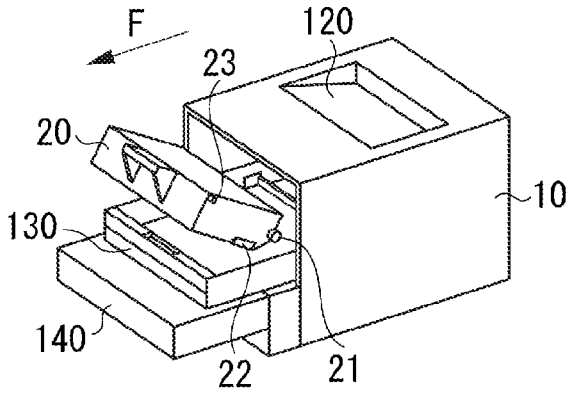
FIGS. 3A, 3B, 3C, and 3D are perspective views illustrating an operation for attaching the process cartridge to an image forming apparatus main body according to the first exemplary embodiment.

When the user attaches the process cartridge 20 to the apparatus main body 10, the user initially opens a door 140 of the apparatus main body 10 as illustrated in FIG. 3A. In a state where the tray 130 is drawn out, the user places the process cartridge 20 on the tray 130 obliquely from above. The door 140 is an opening/closing member which opens and closes an opening of the apparatus main body 10 for the tray 130 to be inserted into.

Figure 3B:
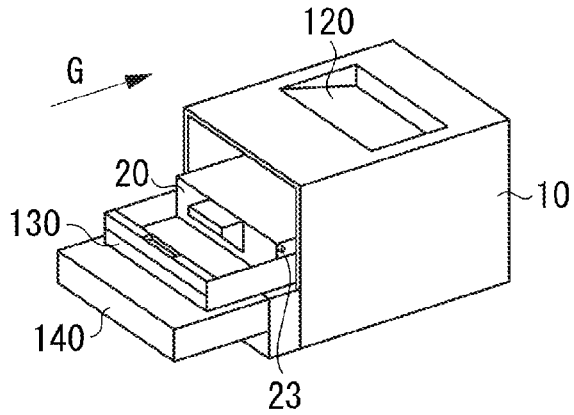
Figure 3C:
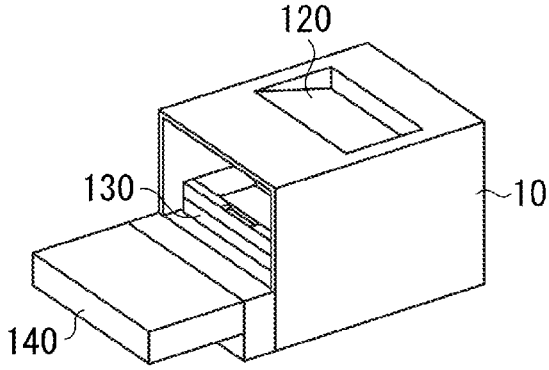
Figure 3D:
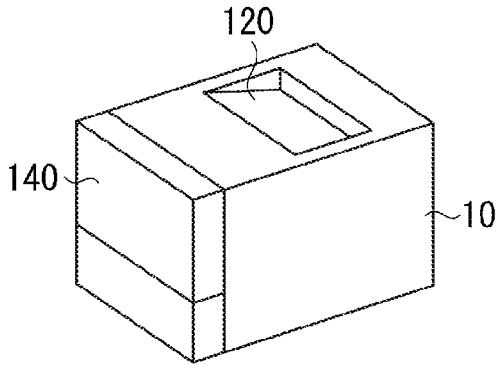

As illustrated in FIG. 3B, the user then inserts the tray 130 on which the process cartridge 20 is placed in the direction of the arrow G. When the insertion of the tray 130 into the apparatus main body 10 is completed as illustrated in FIG. 3C, the attachment of the process cartridge 20 to the apparatus main body 10 is simultaneously completed. Finally, as illustrated in FIG. 3D, the user closes the door 140 to complete the operation for attaching the process cartridge 20 to the apparatus main body 10. The user can draw the process cartridge 20 out of the apparatus main body 10 by a reverse operation.

FIGS. 3A and 3B each illustrate a state where the tray 130 is in an external position (first position) outside the apparatus main body 10. When the tray 130 is in the external position, the process cartridge 20 is detachably attachable to the tray 130.

FIGS. 3C and 3D each illustrate a state where the tray 130 is in an internal position (second position) inside the apparatus main body 10. In the internal position, the tray 130 causes the process cartridge 20 to be positioned by the apparatus main body 10 so that the process cartridge 20 can perform image formation. In other words, in the internal position, the tray 130 arranges the process cartridge 20 in a position capable of image formation.

Next, an operation for inserting the tray 130 on which the process cartridge 20 is placed and the process cartridge 20 into the apparatus main body 10 will be described with reference to FIGS. 4A to 4F.

Figure 4A:
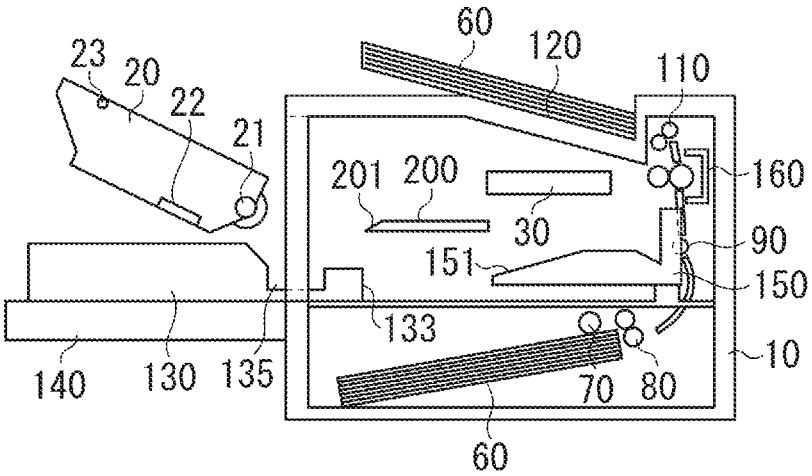
FIGS. 4A, 4B, 4C, 4D, 4E, and 4F are perspective views illustrating the operation for attaching the process cartridge to the image forming apparatus main body according to the first exemplary embodiment.

As illustrated in FIG. 4A, the process cartridge includes a pair of first positioned portions 22 for positioning the process cartridge 20 to the tray 130. The first positioned portions 22 are provided on side walls of the process cartridge 20.

The process cartridge 20 further includes a pair of second positioned portions 21 and a pair of third positioned portions 23 for performing positioning to main body guides 150 and 200 provided on the apparatus main body 10, respectively. The second and third positioned portions 21 and 23 are provided on the side walls of the process cartridge 20.

The second and third positioned portions 21 and are supported portions which are configured to be supported by the apparatus main body 10 when the process cartridge 20 is attached to the apparatus main body 10 (when the tray 130 is moved to the internal position).

The main body guides 150 and 200 are main body side cartridge guides which support the second and third positioned portions 21 and 23 so that the process cartridge 20 is guided for attachment to the apparatus main body 10.

The main body guides 150 and 200 are provided on and fixed to the apparatus main body 10, and support the process cartridge 20 during image formation. To smoothly support the process cartridge 20 inserted into the apparatus main body 10 by the main body guides 150 and 200, the main body guides 150 and 200 include first slopes 151 and third slopes 201, respectively.

Figure 4B:
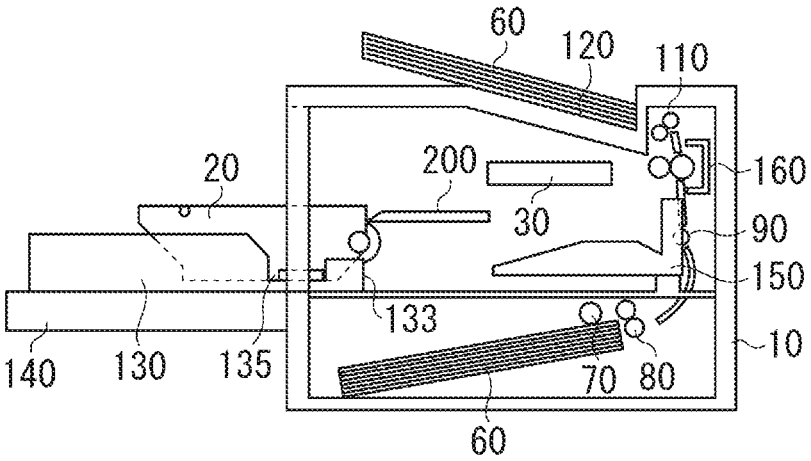
Figure 4C:
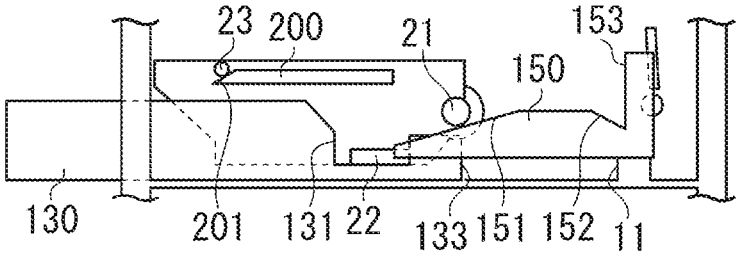
Figure 4D:
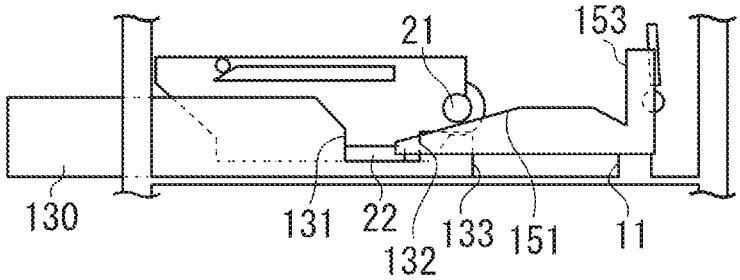
Figure 4E:
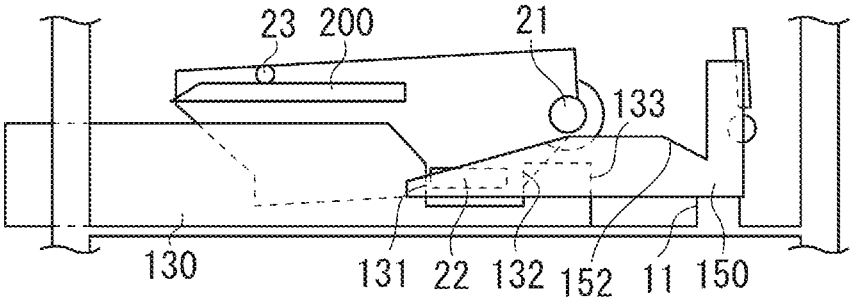
Figure 4F:
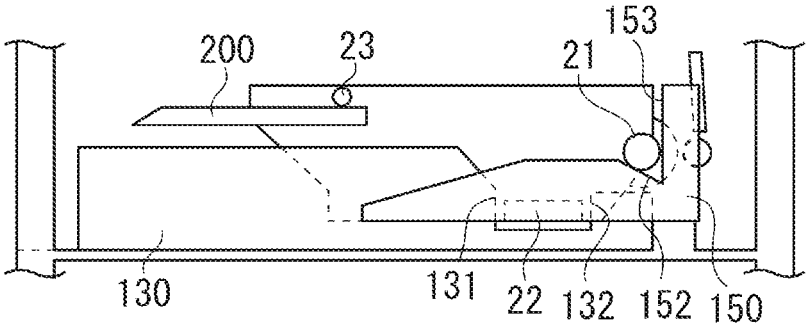

The tray 130 can move from the first position (external position) illustrated in FIG. 4B where the tray 130 is drawn out of the apparatus main body 10 to the second position (internal position) illustrated in FIG. 4F where the tray 130 is inserted in the apparatus main body 10. The door 140 is provided on the apparatus main body 10 to be able to be freely opened and closed by the user. When the door 140 is opened and the tray 130 is drawn out of the apparatus main body 10, the door 140 serves as a support member for supporting the tray 130.

<Operation for Attaching Process Cartridge>

Next, the operation for attaching the process cartridge 20 inside the apparatus main body 10 will be described. To attach the process cartridge 20 to the apparatus main body 10, the process cartridge 20 is initially placed on the tray 130 that is drawn out to the first position above the door 140 as illustrated in FIG. 4A.

As illustrated in FIG. 4B, the first positioned portions 22 of the process cartridge 20 and slits 135 in the tray 130 are engaged with each other. The slits 135 have a width greater than that of the first positioned portions 22. The process cartridge 20 can thus move inside the tray 130 in a front-to-back direction of insertion of the tray 130 into the apparatus main body 10.

Next, the tray 130 on which the process cartridge 20 is placed is inserted into the apparatus main body 10. As illustrated in FIG. 4C, the second positioned portions (protrusions) 21 of the process cartridge 20 come into contact with the first slopes 151 of the main body guides 150 provided on the apparatus main body 10. Here, as illustrated in FIG. 4C, there is a gap between first contact surfaces 131 of the tray 130 and the first positioned portions 22 of the process cartridge 20. In the presence of the gap, the first slopes 151 hinder the process cartridge 20 from following the movement of the tray 130.

As illustrated in FIG. 4D, the tray 130 is pushed further into the apparatus main body 10 in a state where the first contact surfaces 131 of the tray 130 are in contact with the first positioned portions (protrusions) 22 of the process cartridge 20. As a result, the process cartridge 20 is pressed by the first contact surfaces 131. This forms a gap between second contact surfaces 132 and the first positioned portions 22 (the second contact surfaces 132 are not in contact with the first positioned portions 22).

The first contact surfaces 131 of the tray 130 are first force application portions which apply force to the first positioned portions 22 of the process cartridge so that the process cartridge 20 is moved toward the inside of the apparatus main body 10.

When the process cartridge 20 is pressed by the first contact surfaces 131, the second positioned portions 21 provided on the process cartridge 20 start to move over the first slopes 151. At the same time, the third positioned portions 23 of the process cartridge 20 also move over the third slopes 201 of the main body guides 200. The first and third slopes 151 and 201 here are upward inclination portions which are inclined upward in a movement direction (see the arrow G in FIG. 3B) in which the tray 130 moves from the external position to the internal position.

In the process in which the tray 130 moves from the external position to the internal position, the process cartridge 20 therefore moves upward along the first and third slopes 151 and 201. The process cartridge 20 is thereby lifted from the tray 130 (the process cartridge 20 moves upward relative to the tray 130). As a result, the member that supports the process cartridge 20 (member that mainly bears the weight of the process cartridge 20) switches from the tray 130 to the main body guides 150 and 200.

The apparatus main body 10 may include a plurality of upward inclination portions to correspond to the plurality of supported portions (second and third positioned portions 21 and 23) provided on the process cartridge 20. The first slopes 151 are downstream-side upward inclination portions (first upward inclination portions) which are provided downstream (on the right in FIG. 4D) of the third slopes 201 in the movement direction (the arrow G in FIG. 3B) in which the moving member moves toward the internal position. The third slopes 201 are upstream-side upward inclination portions (second upward inclination portions) which are provided upstream of the first slopes 151 in the movement direction. When the tray 130 is pushed further into the apparatus main body 10, through a state illustrated in FIG. 4E, the second positioned portions (protrusions) 21 of the process cartridge 20 reach second slopes 152 as illustrated in FIG. 4F. The second positioned portions 21 of the process cartridge 20 then slide down the second slopes 152 due to the own weight of the process cartridge 20. The second positioned portions 21 then come into contact with abutting surfaces 153 of the main body guides 150 provided on the inner side of the apparatus main body 10, whereby the process cartridge 20 is positioned in the apparatus main body 10. In other words, the second slopes 152 and the abutting surfaces 153 are main body side positioning portions for positioning the second positioned portions 21. More specifically, the abutting surfaces 153 and the second slopes 152 form V-shaped grooves which support the supported portions (second positioned portions 21) of the process cartridge 20. Consequently, the process cartridge is arranged in the position capable of image forming (the process cartridge 20 is positioned).

The abutting surfaces 153 and the second slopes 152 support the supported portions, thereby serving as the main body side positioning portions (first main body side positioned portion). After the process cartridge 20 is positioned by the main body side positioning portions (the abutting surfaces 153 and the second slopes 152), positioning of the photosensitive drum 40 included in the process cartridge 20 is performed. That is, the photosensitive drum 40 is also arranged in a position capable of image formation. More specifically, the photosensitive drum 40 is located in a position where to receive the laser light L from the scanner unit 30 (see FIG. 1) and form a latent image.

The process cartridge 20 (second positioned portions 21) moves downward (descends) due to the second slopes 152. The amount of descent is smaller than the amount of ascent by which the process cartridge 20 (second positioned portions 21) ascends due to the first slopes 151. The process cartridge 20 positioned to the apparatus main body 10 is thus held lifted from the tray 130 at least in part (see FIG. 4F).

The tray 130 is positioned inside the apparatus main body 10 with its front end 133 in contact with an abutting portion 11 provided on the inner side of the apparatus main body 10. The tray 130 is in the internal position (second position). Since the process cartridge 20 slides down the second slopes 152 by its own weight as described above, force receiving portions (first positioned portions 22) of the process cartridge 20 and pushing portions (first contact surfaces 131) of the tray 130 are separated from each other.

Consequently, the process cartridge 20 is supported by only the main body guides 150 and 200 without contact or interference with other members, and can perform image forming in a stable position.

The main body guides 200 support the third positioned portions 23 and thereby suppress rotation of the process cartridge 20 about the second positioned portions 21. In other words, the main body guides 200 also support the supported portions (third positioned portions 23) of the process cartridge 20 so that the process cartridge 20 is positioned to the state (position) capable of image formation. The main body guides 200 serve both as a main body side cartridge guide for guiding the attachment of the process cartridge 20 and as a main body side positioning portion (second main body side positioning portion) for positioning the process cartridge 20.

In the present exemplary embodiment, the user can insert the tray 130 into the apparatus main body 10 to cause the process cartridge 20 to be supported and positioned by the apparatus main body 10 (main body guides 150 and 200).

Unlike heretofore, the tray 130 does not need to be retracted (separated) from the process cartridge 20 in an interlocking manner with the opening and closing of the door 140. The apparatus main body 10 therefore does not need to include an interlocking mechanism for moving the tray 130 in an interlocking manner with the opening and closing of the door 140. The apparatus main body 10 can thus be reduced in size and cost.

That is, in the present exemplary embodiment, when the tray 130 is inserted into the apparatus main body 10, the process cartridge 20 is supported and positioned by the apparatus main body 10 (main body guides 150 and 200) even with the door 140 open (FIG. 3C).

Among the second and third positioned portions 21 and 23 which are the supported portions of the process cartridge 20, the second positioned portions 21 are located downstream (on the right in FIG. 4F) in the movement direction in which the tray 130 moves toward the internal position. In other words, the second positioned portions 21 are downstream-side supported portions (first supported portions). The third positioned portions 23 are upstream-side supported portions (second supported portions) which are located upstream (on the left in FIG. 4F) of the second positioned portions 21 in the movement direction.

<Operation for Drawing Out Process Cartridge>

Next, an operation for drawing the process cartridge 20 out of the apparatus main body 10 will be described.

The basic operation is reverse to that for attaching the process cartridge 20. As with the case of attaching, the following description will thus be given with reference to FIGS. 4A to 4F. As illustrated in FIG. 4F, the process cartridge 20 attached is separated from the tray 130. The process cartridge 20 therefore will not move when the tray 130 starts to be drawn. When the tray 130 is drawn out in such a manner that the second contact surfaces 132 of the tray 130 are in contact with the first positioned portions 22 of the process cartridge 20, the process cartridge 20 follows the movement of the tray 130. In this process, there is a gap between the first contact surfaces 131 and the first positioned portions 22 (the first contact surfaces 131 and the first positioned portions 22 are separated from each other).

The second contact surfaces 132 are second force application portions which, when the tray 130 moves toward the external position (first position), apply force to the force receiving portions (first positioned portions 22) of the process cartridge 20 to move the process cartridge 20 out of the apparatus main body 10.

When the process cartridge 20 is pressed by the second contact surfaces 132, the second positioned portions 21 start to climb the second slopes 152 of the main body guides 150. In this process, the process cartridge 20 is supported by the main body guides 150 and 200. If the tray 130 is further drawn out, as illustrated in FIG. 4D, the first positioned portions 22 and the third positioned portions 23 of the process cartridge 20 slide down the first slopes 151 of the main body guides 150 and the third slopes 201 of the main body guides 200, respectively. The supporting portion that supports the process cartridge 20 switches from the apparatus main body 10 (main body guides 150 and 200) to the tray 130.

The process cartridge 20 supported by the tray 130 is drawn out together with the tray 130 to the first position (external position) capable of attachment to and detachment from the apparatus main body 10 as illustrated in FIG. 4B. The process cartridge 20 thereby becomes attachable to and detachable from the tray 130. In the present exemplary embodiment, the inserting and withdrawing locus of the tray 130 is substantially horizontal.

Figure 5:
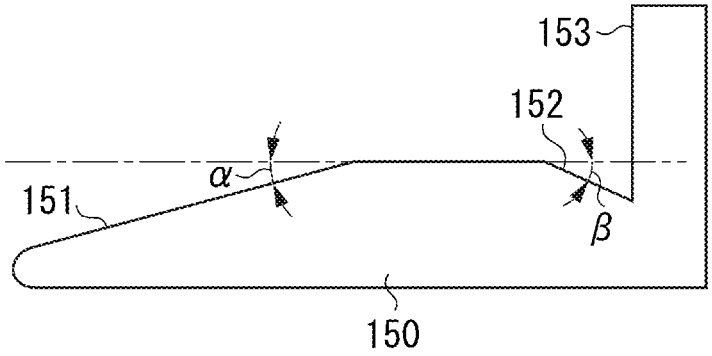
FIG. 5 is an explanatory diagram illustrating a shape of a main body guide according to the first exemplary embodiment.

Next, the first and second slopes 151 and 152 of the main body guides 150 will be further described with reference to FIG. 5.

The first slope 151 is an upward inclination portion which is inclined upward in the movement direction (see the arrow G in FIG. 3) in which the tray 130 moves from the first position (external position) to the second position (internal position). When the process cartridge is attached to the apparatus main body 10, the user inserts the tray 130 as described above. The first contact surfaces 131 press the first portions to be position 22 of the process cartridge 20, and the process cartridge 20 climbs the first slope 151. The smaller the angle $\alpha$ formed between the first slope 151 and the horizontal plane, the smaller the resistance of insertion of the process cartridge 20 and the smaller the user's operation force (the smaller the force required to be provided by the user).

When the second positioned portion 21 of the process cartridge 20 reaches the second slope 152, the process cartridge 20 slides down the second slope 152. That is, the greater the angle $\beta$ formed between the second slope 152 and the horizontal plane, the more stably the process cartridge 20 is positioned to the apparatus main body 10 when the tray 130 is in the second position.

For such reasons, the second positioned portion 21 of the process cartridge 20 is set as follows:

$\alpha$ (the angle formed between the first slope and the horizontal plane)$<\beta$ (the angle formed between the second slope and the horizontal plane).

Such a relationship can facilitate inserting the process cartridge 20 into the apparatus main body 10 at the time of insertion, and stabilize the position of the process cartridge 20 with respect to the apparatus main body 10 during image formation.

The second slope 152 is a downward inclination portion which is inclined downward in the moving direction in which the tray 130 moves from the first position (the external position) to the second position (the internal position). After the second positioned portion 21 (supported portion) passes the first slope 151 (upward inclination portion) and before the second positioned portion 21 is supported by the abutting surface 153 (main body side positioning portion), the second slope 152 guides the second positioned portion 21 toward the abutting surface 153.

An example of using an integrated process cartridge in which the developing unit 220 and the cleaning unit 230 are integrated has been described. However, the present invention is not limited to the use of an integrated process cartridge. For example, the developing unit 220 and the cleaning unit 230 may be configured as respective separate cartridges and attached to the apparatus main body 10. In the foregoing first exemplary embodiment, one process cartridge is described to be attached to the apparatus main body 10. However, the present invention is not limited to the cases of using a single process cartridge for the apparatus main body 10.

Next, a second exemplary embodiment of the present invention will be described with reference to FIGS. 6A and 6B.

An image forming apparatus according to the present exemplary embodiment has a basic configuration similar to that of the foregoing first exemplary embodiment. Redundant descriptions will thus be omitted, and a specific configuration of the present exemplary embodiment will be described here. Members having similar functions to those of the foregoing first exemplary embodiment are designated by the same reference numerals.

Figure 6A:
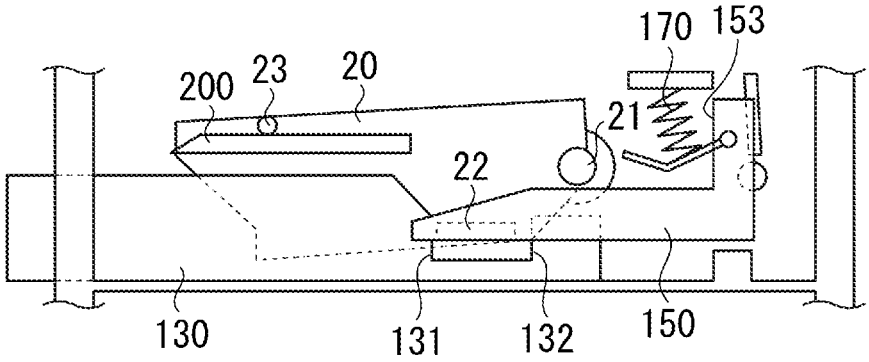
FIGS. 6A and 6B are sectional views illustrating an operation for attaching the process cartridge to an image forming apparatus main body according to a second exemplary embodiment.
Figure 6B:
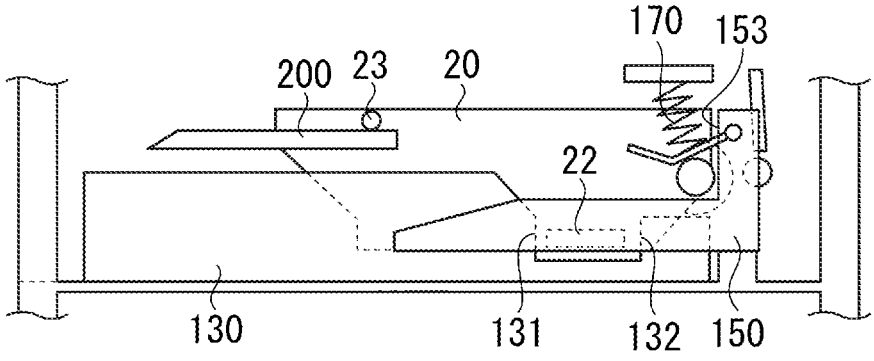

The present exemplary embodiment differs from the first exemplary embodiment in that the main body guides 150 do not include the second slopes 152 illustrated in FIGS. 6A and 6B. In the present exemplary embodiment, unlike the first exemplary embodiment, the second positioned portions (protrusions) 21 of the process cartridge 20 are biased in a manner such that the second positioned portions 21 are in contact with the abutting surfaces 153 of the main body guides 150 by using springs 170 from above the process cartridge 20. The springs 170 are biasing portions which bias the supported portions (second positioned portions 21) provided on the process cartridge 20 toward the main body side positioning portions (abutting surfaces 153).

The biasing of the second positioned portions 21 by the springs 170 can stabilize the position of the process cartridge 20 with respect to the apparatus main body 10 independently of the weight of the process cartridge 20. Even in the first exemplary embodiment, biasing portions (springs 170) similar to those of the second exemplary embodiment may be added so that the position of the process cartridge 20 can be more reliably fixed. In the present exemplary embodiment, the springs 170 are arranged above the process cartridge 20. However, the springs 170 may be arranged below the process cartridge 20.

Next, a third exemplary embodiment will be described with reference to FIGS. 7A and 7B.

An image forming apparatus according to the present exemplary embodiment has a basic configuration similar to that of the foregoing first exemplary embodiment. Redundant descriptions will thus be omitted, and a specific configuration of the present exemplary embodiment will be described here. Members having similar functions to those of the foregoing first exemplary embodiment are designated by the same reference numerals.

Figure 7A:
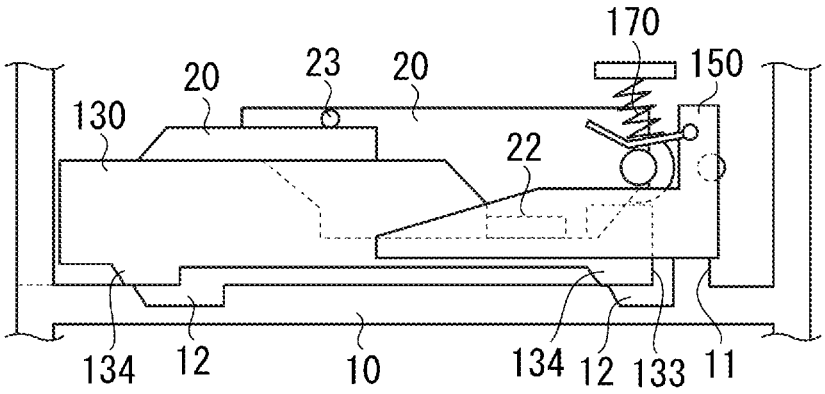
FIGS. 7A and 7B are sectional views illustrating an operation for attaching the process cartridge to an image forming apparatus main body according to a third exemplary embodiment.
Figure 7B:
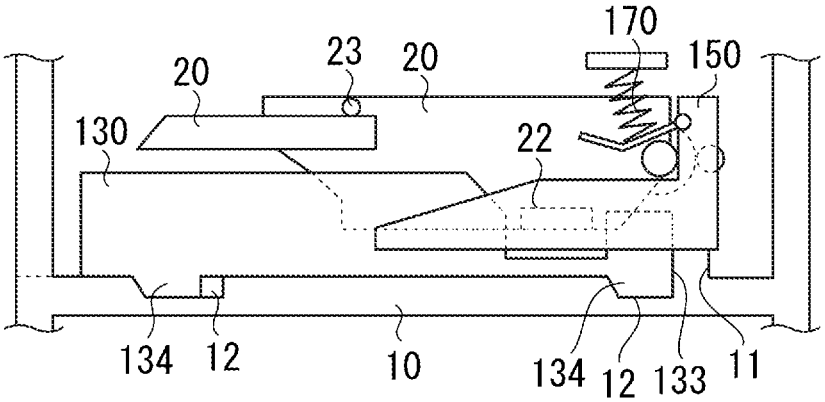

FIGS. 7A and 7B are sectional views illustrating the image forming apparatus according to the present exemplary embodiment.

The third exemplary embodiment differs from the first exemplary embodiment in that when the process cartridge 20 moves inside the apparatus main body 10, the process cartridge 20 does not move vertically upward as being guided by the slopes but moves substantially horizontally. In the meantime, the tray 130 performs vertical motions while moving inside the apparatus main body 10, whereby the support and separation of the process cartridge 20 by/from the tray 130 is implemented.

A specific configuration will be described below. As illustrated in FIG. 7A, protruded portions 134 are provided on the bottom of the tray 130. Recesses 12 are formed in the apparatus main body 10 to correspond to the protruded portions 134.

In FIG. 7A, the process cartridge 20 is supported by the tray 130 and follows the movement of the tray 130. When the tray 130 is further inserted into the apparatus main body 10 as illustrated in FIG. 7B, the protruded portions 134 of the tray 130 move along the recesses 12 in the apparatus main body 10 and the tray 130 moves downward. When the protruded portions 134 fall into the recesses 12, the tray 130 moves away from the process cartridge 20 downward. The supporting portion that supports the process cartridge 20 thus switches from the tray 130 to the main body guides 150 and 200.

In the present exemplary embodiment, the recesses 12 are part of a guide (main body side moving member guide) for guiding movement of the tray 130 toward the internal position (second position). The recesses 12 (main body side moving member guide) causes the tray 130 descend in the process in which the tray 130 moves toward the internal position. As a result, the recesses 12 (main body side moving member guide) function to shift the process cartridge 20 from a state of being supported by the tray 130 to a state of being supported by the apparatus main body 10 (main body guides 150 and 200).

When the tray 130 is further pushed in, the front end 133 of the tray 130 comes into contact with the abutting portion 11 of the apparatus main body 10, whereby the attachment of the tray 130 to the apparatus main body 10 is completed. Here, the process cartridge 20 is biased in a manner such that the process cartridge 20 is in contact with the main body guides 150 by the springs 170. The process cartridge 20 and the tray 130 are separated from each other. In the third exemplary embodiment, the process cartridge 20 does not need to climb the slopes of the support members provided on the apparatus main body 10 along the attaching and detaching locus. This can reduce the user's operation force as compared to the first exemplary embodiment if the process cartridge 20 has a heavy weight.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242594, filed Nov. 28, 2014, which is hereby incorporated by reference herein in its entirety.

What is claimed is:

1. An image forming apparatus for forming an image on a recording medium, the image forming apparatus comprising:

an apparatus main body;

a cartridge including a supported portion;

a main body side positioning portion provided on the apparatus main body and configured to position the cartridge in a position capable of image formation by supporting the supported portion;

a moving member configured to move with respect to the apparatus main body and thereby move the cartridge, the moving member being moveable between an external position, in which the moving member is positioned at least partially outside the apparatus main body and wherein the cartridge is attachable and attachable from the image forming apparatus when the moving member is in the external position, and an internal position in which the moving member is positioned at least substantially inside the apparatus main body and wherein the cartridge is positioned by contacting with the main body side positioning portion when the moving member is in the internal position; and an upward inclination portion provided on the apparatus main body and inclined upwardly from a movement direction in which the moving member moves from the external position to the internal position, wherein the upward inclination portion moves the cartridge upward with respect to the moving member by contacting with the supported portion of the cartridge in a process in which the moving member moves from the external position to the internal position wherein the moving member includes a first force application portion arranged to apply, when the moving member moves toward the internal position, a force to a force reception portion provided on the cartridge to move the cartridge into the apparatus main body, and while the moving member moves from the external position to the internal position, the cartridge moves upward in a state where contacting to the upward inclination portion and the first force application portion, and wherein the first force application portion and the force reception portion are, when the moving member is in the internal position, separated from each other.

2. The image forming apparatus according to claim 1, wherein the apparatus main body includes a main body side cartridge guide configured to guide the supported portion to the main body side positioning portion, and wherein the upward inclination portion is provided on the main body side cartridge guide.

3. The image forming apparatus according to claim 1, wherein the apparatus main body includes a downward inclination portion inclined downwardly from the movement direction, wherein the downward inclination portion is configured to, after the supported portion passes the upward inclination portion and before the supported portion is positioned by the main body side positioning portion, guide the supported portion toward the main body side positioning portion by coming into contact with the supported portion, and wherein the downward inclination portion is arranged to move the cartridge downward with respect to the moving member in a process in which the moving member moves from the external position to the internal position.

4. The image forming apparatus according to claim 3, wherein an amount of ascent by which the upward inclination portion causes the supported portion to move upward is greater than an amount of descent by which the downward inclination portion causes the supported portion to move downward.

5. The image forming apparatus according to claim 3, wherein $\alpha<\beta$ holds, where $\alpha$ is an angle formed between the upward inclination portion and a horizontal plane, and $\beta$ is an angle formed between the downward inclination portion and the horizontal plane.

6. The image forming apparatus according to claim 1, wherein the apparatus main body includes an opening/closing member configured to open and close an opening for the moving member to be inserted into, and wherein movement of the moving member from the external position to the internal position causes the cartridge to be positioned by the main body side positioning portion while the opening/closing member is opened.

7. The image forming apparatus according to claim 1, wherein the supported portion includes a first supported portion and a second supported portion as the supported portion, the second supported portion being located upstream of the first supported portion in the movement direction, and wherein the upward inclination portion includes a first upward inclination portion configured to contact with the first supported portion and a second upward inclination portion configured to contact with the second supported portion.

8. The image forming apparatus according to claim 1, further comprising a biasing portion configured to, when the moving member is in the internal position, bias the supported portion to the main body side positioning portion.

9. The image forming apparatus according to claim 1, wherein the moving member includes a second force application portion configured to, when the moving member moves to the external position, apply force to the cartridge to move the cartridge out of the apparatus main body.

10. The image forming apparatus according to claim 1, wherein the cartridge includes an image bearing member configured to bear a developer image.

11. The image forming apparatus according to claim 1, wherein the cartridge includes a developer bearing member configured to bear a developer and develop a latent image.

* * * * *